US006854903B2

(12) United States Patent
Wiechers et al.

(10) Patent No.: US 6,854,903 B2
(45) **Date of Patent: *Feb. 15, 2005**

(54) SYSTEM AND METHOD FOR IMAGE FORMATION THROUGH LAMINATION

(75) Inventors: Alelandro Wiechers, Jalisco (MX); Benjamin Huerta, Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/634,246

(22) Filed: Aug. 5, 2003

(65) Prior Publication Data

US 2004/0028440 A1 Feb. 12, 2004

Related U.S. Application Data

(63) Continuation of application No. 09/935,807, filed on Aug. 23, 2001, now Pat. No. 6,632,036.

(51) Int. Cl.[7] ..... B41J 11/44

(52) U.S. Cl. ..... 400/76; 400/70; 101/485

(58) Field of Search ..... 400/76, 70, 61, 400/62; 101/484, 485

(56) References Cited

U.S. PATENT DOCUMENTS 4,773,677 A * 9/1988 Plasse ..... 283/77
4,999,065 A * 3/1991 Wilfert ..... 156/64
5,637,174 A * 6/1997 Field et al. ..... 156/256
5,786,910 A * 7/1998 Walters et al. ..... 359/2

* cited by examiner

*Primary Examiner*—Minh Chau

(57) ABSTRACT

A lamination imaging system of the present invention includes a printing system and a lamination module connected to the printing system. The lamination module includes a module logic unit for generating imaging instructions. The lamination module forms an image from a plurality of printed sheets sent from the printing system based on these imaging instructions. In particular, through a lamination finishing sequence, the lamination module laminates the plurality of printed sheets to form the image.

9 Claims, 3 Drawing Sheets

SYSTEM AND METHOD FOR IMAGE FORMATION THROUGH LAMINATION

CROSS REFERENCE TO RELATED APPLICATION(S)

This is a continuation, now U.S. Pat. No. 6,632,036 of application Ser. No. 09/935,807 filed on Aug. 23, 2001, which is hereby incorporated by reference herein.

FIELD OF THE INVENTION

This invention relates to forming images through lamination by incorporating a lamination module with a printer. In particular, the invention relates to a system and method for forming an image by combining a plurality of printed sheets through lamination.

BACKGROUND OF THE INVENTION

Today, if one wishes to enlarge a document, an electronic device, such as a computer, a wireless device or an internet appliance, sends a print job command to a printer. In particular, a printer driver installed within the electronic devices's operating system software component sends a print job command so that a printed image is formed on printed sheets. Typically, a printer driver configures each printed image to fit on a single printed sheet of a predetermined size. Although a printed image may be scaled for enlargement or reduction on a single printed sheet, current printers do not arrange a series of printed sheets so as to form a single printed image. Moreover, today's printers do not provide for enlargement of a printed image on a series of printed sheets.

SHORT STATEMENT OF THE INVENTION

Accordingly, a lamination imaging system of the present invention includes a printing system and a lamination module connected to the printing system. The lamination module includes a module logic unit for generating imaging instructions. The lamination module then forms an image from a plurality of printed sheets sent from the printing system based on these imaging instructions. In particular, through a lamination finishing sequence, the lamination module laminates the plurality of printed sheets to form the image.

Illustratively, the lamination module may create a single image, an enlarged image, and/or a contiguous image from the plurality of printed sheets. Some examples of images include alphanumeric information including a text document, graphic information including drawings, and photographic information including digital or video pictures. As shown in FIG. 3, the module logic unit configures the desired image from the plurality of printed sheets in a variety of arrangements, such as a "matrix" or a "train" configuration.

The lamination module further includes an arrangement unit linked with the module logic unit. The arrangement unit positions the plurality of printed sheets received by the printing system so that the lamination module forms the desired image by laminating these arranged printed sheets.

In a further embodiment of the present invention, a method for image formation through lamination includes connecting a printing system with a lamination module and then forming an image with the lamination module from a plurality of printed sheets. The method further includes executing a lamination finishing sequence with the lamination module.

With the lamination finishing sequence, a module logic unit of the lamination module receives a print job command from the printing system. By reading the print job command, the module logic unit determines whether a desired image is larger than allowable standard settings for the printing system. If larger, the lamination finishing sequence identifies user preferences associated with the document command. The module logic unit generates imaging instructions based on these user preferences. The lamination finishing sequence then facilitates printing and lamination based on the imaging instructions.

In sum, as a matter of enhancing imaging capacity for printing systems, there is a clear need for a lamination imaging system that forms an image from a plurality of printed sheets. Therefore, it is an object of this invention to provide a system and method for forming an image through lamination by combining a plurality of printed sheets.

BRIEF DESCRIPTION OF THE DRAWINGS

Other objects, features, and advantages of the present invention will become more fully apparent from the following detailed description of the preferred embodiment, the appended claims and the accompanying drawings in which:

FIG. 3*a* shows an optional gap configuration. FIG. 3*b* shows an optional overlap configuration. FIG. 3*c*. Shows a series of matrix configurations. Lastly, FIG. 3*d* shows a train configuration.

DETAILED DESCRIPTION OF THE PREFERRED EMBODIMENT

Figure 1:
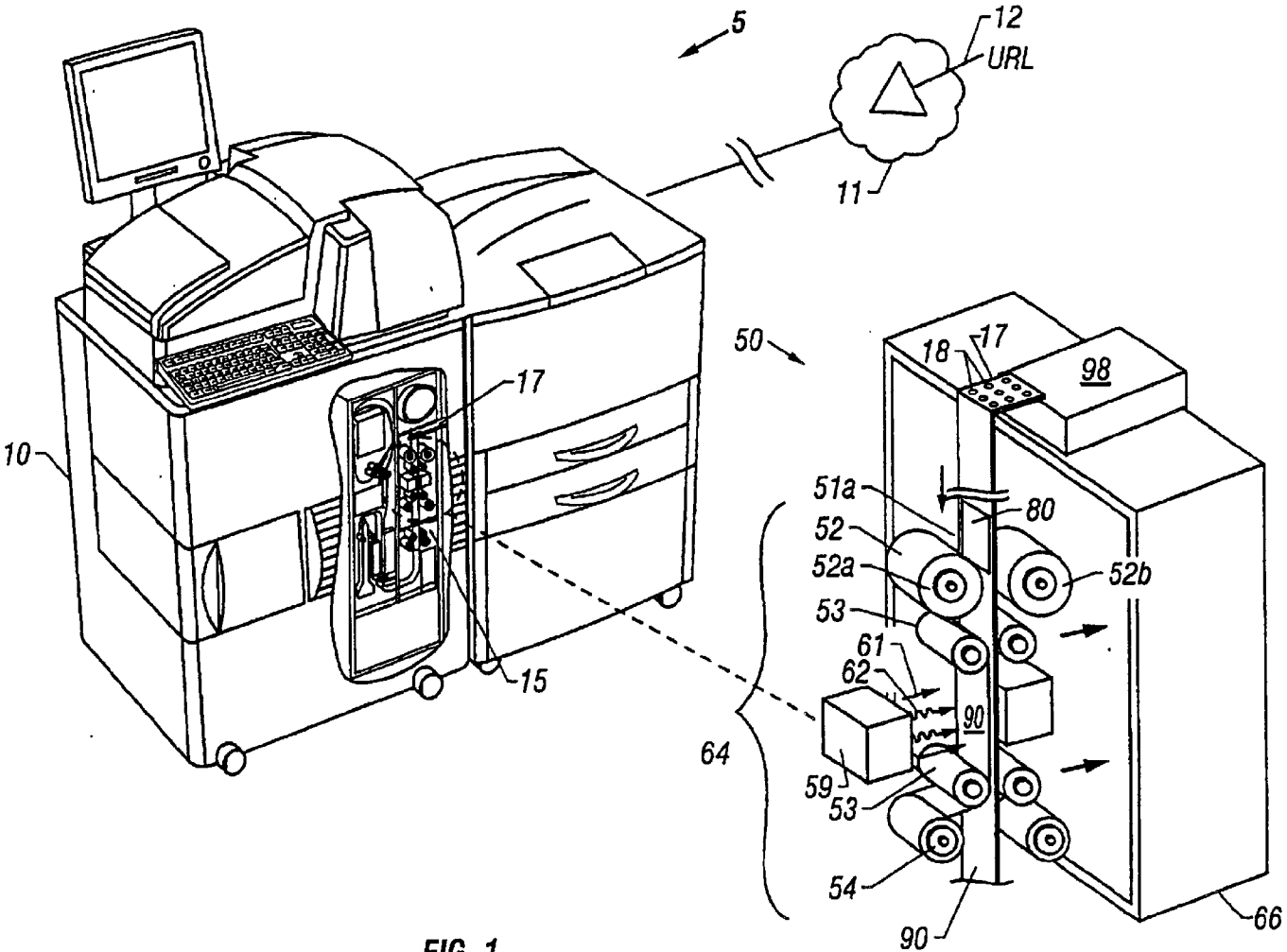
FIG. 1 is a partially exploded view illustrating a lamination imaging system of the present invention including a lamination module projecting therefrom.
Figure 2:
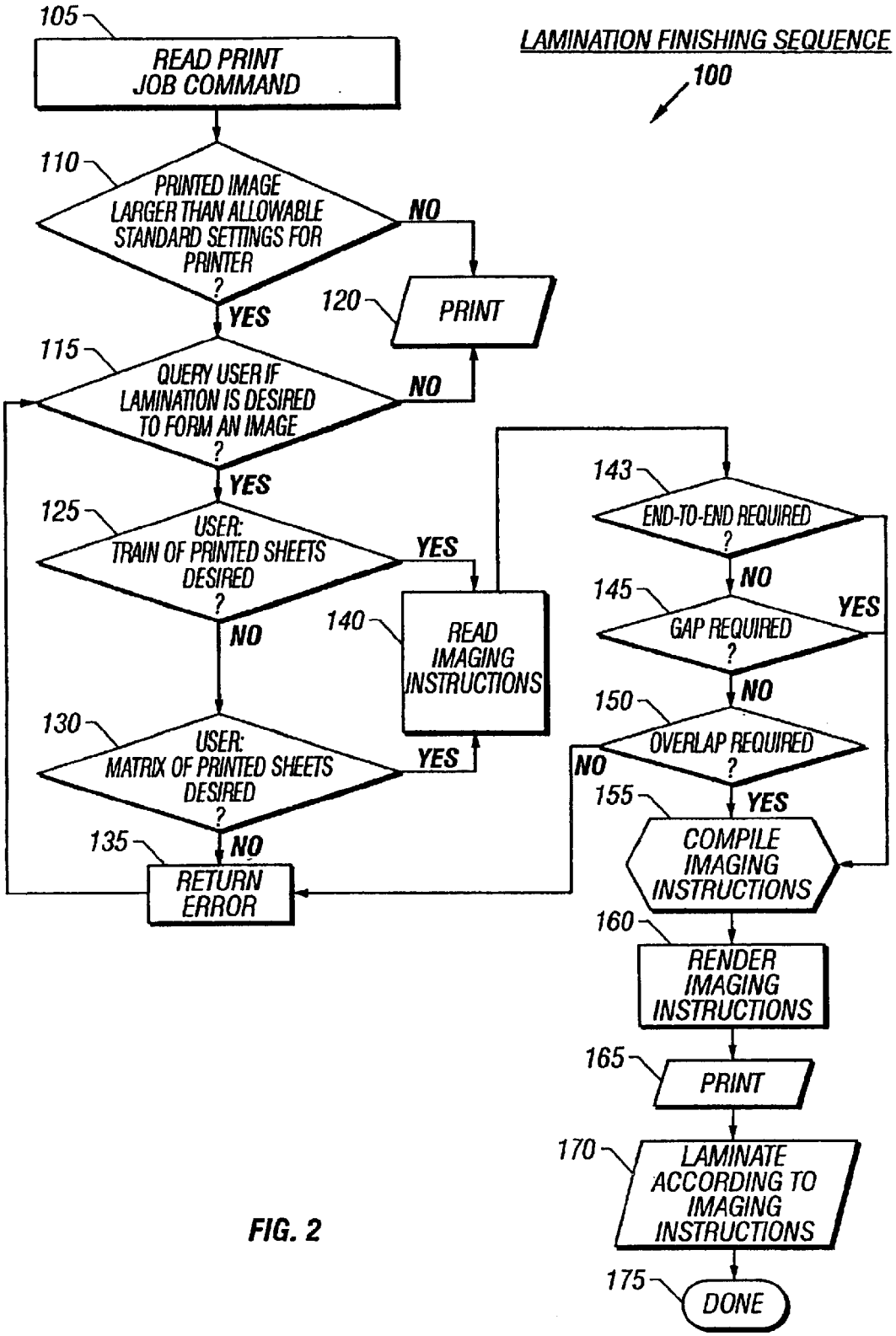
FIG. 2 is a flow diagram of a lamination finishing sequence executed by the lamination module of FIG. 1.

The preferred embodiment of the present invention is illustrated by way of example in FIGS. 1–3. With specific reference to FIG. 1, lamination imaging system 5 (hereinafter referred to as the "system") includes a printing system 10 and a lamination module 50 connected to the printing system 10. In general, the lamination module 50 forms an image from a plurality of printed sheet(s) 80.

In the application and appended claims the terms "print information", "printed image" or, simply, "image" refers to a predetermined set of information for printing onto a printed sheet 80 by the printing system 10. Some examples of images include alphanumeric information including a text document, graphic information including drawings, and photographic information including digital or video pictures. Moreover, each sheet of the printed sheets 80 may comprise, for example, standard printer paper, preprinted material, letterhead, transparencies, vellum, labels, bond paper, rough card stock, colored paper, and recycled paper.

Optionally, as shown in FIG. 1, the system 5 may include a communication network 11 linked with the printing system 10. In a preferred embodiment, the communication network 11 comprises an Internet communication network environment, but other embodiments contemplate other communication networks, such as an Intranet communication environment for example. The communications network 11 includes at least one Uniform Resource Locator (hereinafter "URL") 12. Illustratively, the URL 12 sends information to the printing system 10. The printing system 10 may then print information received from the URL 12 as a printed image.

For the present invention, the printing system 10 comprises a printer of a type well known in the industry. Examples of well known printers include a Hewlett-Packard MARCOM Point-of-Need (PON) Print Shop and small sized printers such as a Hewlett-Packard LASERJET 8100 or color LASERJET 8550.

With specific reference to FIG. 1, the lamination module 50 includes a lamination assembly 64 and a module logic unit 66 linked with the lamination assembly 64. The module logic unit 66, in operation, generates imaging instructions. The lamination assembly 64, in turn, forms an image from a plurality of printed sheets 80 based on the imaging instructions.

The lamination assembly 64 is configured for laminating one or both sides of the two sides provided by each printed sheet 80. As shown in FIG. 1, the lamination assembly 64 features an application arrangement 51 including a first application surface 51*a* and a second application surface 51*b*. Each application surface 51*a*, 51*b* applies lamination media 90 to one respective side of the printed sheet 80. Therefore, in general, component elements comprising the lamination assembly 64 for use with the first application surface 51 a are identical to component elements for use with the second application surface 51*b*.

Accordingly, for purposes of illustration, consider the component elements of the lamination assembly 64 for use with the first application surface 51*a*. Referring to FIG. 1, the lamination assembly 64 thus includes a supply roller 52 and a driver roller 54 opposingly positioned from the supply roller 52 along the first application surface 51*a*. The supply roller 52 includes laminate media 90 in stock form. As discharged from the supply roller 52, laminate media 90 laminates one side of the printed sheet 80 along the first application surface 51*a*. In stock form, the laminate media 90 is removably attached to a substrate (not shown). In operation, laminate media 90 in stock form is taken from the supply roller 52 and disposed on one side of the printed sheet 80 so that the residual substrate is taken up by the driver roller 54.

The lamination assembly 64 also includes a plurality of take rollers 53. Operatively, the take rollers 53 exert compressive and tensile forces or, as commonly referred to, "nip" against the lamination media 90, as is required for laminating one side of the printed sheet 80. Shown in FIG. 1, the nip is referenced as arrow 61. It should also be added that at least one take roller 53 is positioned adjacent to the supply roller 52 and to the driver roller 54 as well.

The lamination assembly 64, in a preferred embodiment, includes a heat source 59. Preferably, the heat source 59 is placed adjacent to the take rollers 53. As indicated on FIG. 1 by heat vector 62, the heat source 59 sends heat energy to the laminate media 90. In conjunction with the nip provided by the take rollers 53, the heat source 59 emits heat energy to thereby laminate one side of the printed sheet 80.

Referring now to FIG. 2, with reference to the module logic unit 66, the printing system 10 sends a print job command to the module logic unit 66. Based on the print job command, the module logic unit 66 executes a lamination finishing sequence 100 of FIG. 2 to facilitate generation of imaging instructions. From the imaging instructions, the lamination finishing sequence 100 facilitates operation of the lamination assembly 64 to form an image from a plurality of printed sheets.

As illustrated in step 105 of FIG. 2, the module logic unit 66 initiates the lamination finishing sequence by reading the print job command sent from the printing system 10. In step 110, the module logic unit 66 determines whether the print job command requires forming an image through lamination.

In a preferred embodiment, step 110 determines whether the desired printed image is larger than allowable standard settings for the printing system 10. The standard settings are preset within the printing system 10 by default and normally print an image on a single printed sheet 80. For a desired printed image that is within the standard settings, the module logic unit 66 in step 120 defers to the printing system 10 to print that desired image.

However, if larger than the standard settings, the module logic unit 66 in step 115 queries a system user if lamination is desired to form the needed image. If lamination is not desired, the module logic unit 66 in step 120 defers to the printing system 10 to print the image in a series of printed sheets 80. Without choosing the lamination module 50 to form the desired image through lamination, the system user must manually collect, arrange, and form the desired image with that series of printed sheets.

The lamination finishing sequence advances from step 115 to 125. Prior to forming the desired image with the lamination module 50, the module logic unit 66 determines user preferences in steps 125, 130, 143, 145, and 150. Generally, user preferences are gathered from the document command. User preferences are a combination of instructions operationally generated from the system 5 and received from system user input.

Although those of ordinary skill in the art will recognize other user preferences, the preferred user preferences for the present invention are illustrated in FIG. 3. In particular, FIG. 3 shows user preferred configurations for printed image formation through lamination.

Accordingly, based on user input in steps 125 or 130, the module logic unit 66 in step 140 determines whether either a train configuration of printed sheets 80 in step 125 or a matrix configuration in step 130 is desired. The module logic unit 66, however, will return an error message to the system user in step 135 if neither a train nor matrix configuration is desired.

Figure 3A:
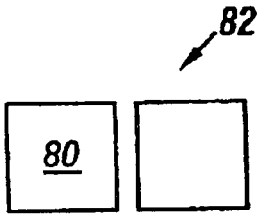
FIGS. 3*a–d* are schematic diagrams illustrating preferred configurations for printed image formation through lamination.
Figure 3B:
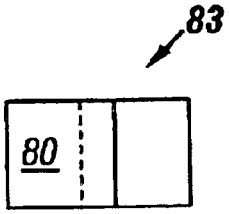
Figure 3C:
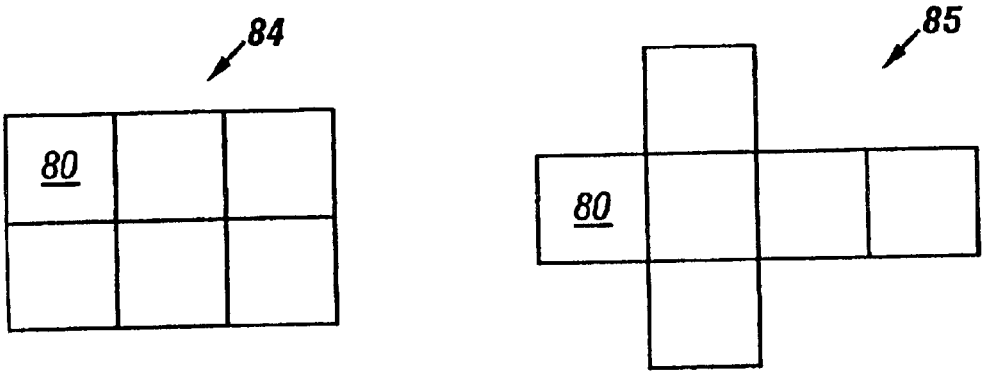
Figure 3D:
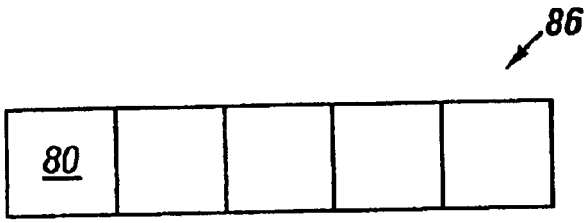

As shown in FIG. 3*d*, a train configuration, for example, is characterized by printed sheets 80 arranged in a row whereas a matrix configuration of FIG. 3*c* refers to printed sheets 80 arranged to include a plurality of rows and columns. It should be added that one preferred embodiment contemplates a train configuration formed of at least two printed sheets 80 whereas another preferred embodiment contemplates a matrix configuration formed of at least two printed sheets 80. Ultimately, the desired image is transposed by the system 5 onto a user preferred configuration so that the image is thus formed by laminating a plurality of printed sheets 80.

Based on system instructions from the document command, the module logic unit 66 determines whether, a normal end-to-end configuration of printed sheets 80 in step 143, an optional gap configuration in step 145 or an optional matrix configuration in step 150 is desired. In step 135, the module logic unit 66 will, however, return an error message to the system user in step 135 if system instructions do not indicate a normal end-to-end configuration or the optional gap or overlap configurations. Moreover, in the alternative to receiving operational commands from the document command, it should be added that in another preferred embodiment, the module logic unit 66 executes steps 143, 145, and 150 as based on operational commands received from system user input.

Illustratively, in operation, once either a train or a matrix configuration is selected by the system user, the module logic unit 66 determines whether a normal end-to-end configuration is desired, as shown in FIGS. 3*c* and 3*d* or a optional gap is desired as shown in FIG. 3*a* or an optional overlap is desired, shown in FIG. 3*b*. As typically used in the industry, a gap is optimal for folding a desired image, such as for a magazine or pamphlet, whereas an overlap provides reinforced mechanical strength to the resulting printed image, such as for a poster.

In step 155 of FIG. 2, the module logic unit 66 compiles a combination of instructions operationally generated by the system and received from system user input in steps 125, 130, 143, 145, and 150. Thus, in step 160, the module logic unit 66 renders these compiled instructions into imaging instructions. Imaging instructions refer to code in a format for execution by the lamination imaging system 5. In step 165, the print system 10 prints the desired image onto the plurality of printed sheets 80 based on the imaging instructions generated by the module logic unit 66 in step 160. Then, based on the imaging instructions, the lamination module 50 in step 170 forms the desired image by laminating the plurality of printed sheets 80 before completing the lamination finishing sequence 100 in step 175.

Illustratively, an image formed by the lamination module 50 may comprise a single image, such as a panoramic picture of the Grand Canyon for example. The desired image may comprise a plurality of images such as a magazine fold-out having merchandising information or a restaurant menu consisting of alphanumeric, graphic, and photographic information. The printed sheets may also be arranged to form a contiguous image, such as for example a geographical map as well as the above panoramic view of the Grand Canyon. It must be said that the lamination module 50 optimally forms enlarged images. For example, the lamination module 50 may form a "wall-sized" image from a plurality of printed sheets 80 based on photographic information initially provided from a "wallet-sized" photograph. Indeed, for images formed by the lamination module 50 of the present invention, creativity is the limit.

With specific reference to FIG. 1, it must be added that in addition to the module logic unit 66 and the lamination assembly 64, the lamination module 50 further includes an arrangement unit 98. The arrangement unit 98 is linked with the module logic unit 66 and facilitates formation of the desired image by arranging or "configuring" the plurality of printed sheets prior to lamination by the lamination assembly 64.

Although its specific elements are beyond the scope of the present invention, the arrangement unit 98 includes software and hardware components for configuring printed sheets 80 ultimately in accordance with desired configurations shown in FIG. 3. In other words, the arrangement unit 98 positions the plurality printed sheets 80 received by the printing system 10 so that the lamination module 50 forms the desired image by laminating the arranged sheets 80.

In FIG. 1, the arrangement unit 98 includes a printed sheet input platform assembly 17. In operation, the arrangement unit 98 positions the plurality of printed sheets 80 received from the printing system 10 on the printed sheet input platform assembly 17. The arrangement unit 98 further includes a printed-sheet-position sensor array 18 disposed along the printed sheet platform assembly 17. By coordinating with the imaging instructions from the module logic unit 66 and printed sheet positioning data obtained by the printed-sheet-position sensor array 18, the arrangement unit 98 thus arranges the plurality of printed sheets 80 on the printed sheet input platform assembly 17 in accordance with the desired image prior to delivery to the lamination module 50 for lamination.

Furthermore, as shown in FIG. 1, lamination module 50 may optionally include a lamination media trimmer assembly 15. The lamination media trimmer assembly 15 is linked with the module logic unit 66 and the lamination assembly 64 and is positioned adjacent to the driver roller 54. Operatively, once the image is formed by the lamination assembly 64, the lamination media trimmer assembly 15 trims unwanted lamination media 90 from the formed image in accordance with the imaging instructions from the module logic unit 66.

While the present invention has been disclosed in connection with the preferred embodiments thereof, it should be understood that there may be other embodiments which fall within the spirit and scope of the invention as defined by the following claims.

What is claimed is:

1. A method for image formation through lamination, comprising the steps of;

(a) connecting a printing system with a lamination module; and (b) forming an image from a plurality of partial images on printed sheets with the lamination module.

2. The method of claim 1 wherein the step of forming an image includes forming a contiguous image.

3. The method of claim 1 wherein the step of forming an image includes the forming an enlarged image with multiple separate images.

4. A method for image formation through lamination, comprising the steps of:

(a) connecting a printing system with a lamination module;

(b) forming an image from a plurality of partial images on printed sheets with the lamination module; and (c) generating imaging instructions with the lamination module.

5. A method for image formation through lamination, comprising the steps of:

(a) connecting a printing system with a lamination module;

(b) forming an image from a plurality of partial images on printed sheets with the lamination module; and (c) forming an enlarged image with the lamination module from the plurality of printed sheets.

6. A method for image formation through lamination, comprising the steps of:

(a) connecting a printing system with a lamination module;

(b) forming an image from a plurality of partial images on printed sheets with the lamination module;

(c) executing a lamination finishing sequence with the lamination module; and (d) determining from the print job command whether a desired image is larger than allowable standard settings for the printing system.

7. A method for image formation through lamination, comprising the steps of:

(a) connecting a printing system with a lamination module;

(b) forming an image from a plurality of partial images on printed sheets with the lamination module;

(c) executing a lamination finishing sequence with the lamination module; and (d) determining user preferences associated with the print job command and generating imaging instructions with the lamination module based on the user preferences.

8. A method for image formation through lamination, comprising the steps of:

(a) connecting a printing system with a lamination module;

(b) forming an image from a plurality of partial images on printed sheets with the lamination module;

(c) executing a lamination finishing sequence with the lamination module;

(d) determining user preferences associated with the print job command and generating imaging instructions with the lamination module based on the user preferences; and (e) printing based on imaging instructions.

9. A method for image formation through lamination, comprising the steps of:

(a) connecting a printing system with a lamination module;

(b) forming an image from a plurality of partial images on printed sheets with the lamination module;

(c) executing a lamination finishing sequence with the lamination module;

(d) determining user preferences associated with the print job command and generating imaging instructions with the lamination module based on the user preferences; and (e) laminating based on the imaging instructions.

* * * * *

UNITED STATES PATENT AND TRADEMARK OFFICE

CERTIFICATE OF CORRECTION

PATENT NO. : 6,854,903 B2 
DATED : February 15, 2005
INVENTOR(S) : Alejandro Wiechers et al.

It is certified that error appears in the above-identified patent and that said Letters Patent is hereby corrected as shown below:

Column 2,
Line 31, after "FIG. 3c." delete "Shows" and insert therefor -- shows --.

Column 3,
Line 23, delete "51 a" and insert therefor -- 51a --.

Column 6,
Line 22, delete "of;" and insert therefor -- of: --.

Signed and Sealed this

Fifteenth Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,854,903 B2 
DATED : February 15, 2005
INVENTOR(S) : Alejandro Wiechers et al.

It is certified that error appears in the above-identified patent and that said Letters Patent is hereby corrected as shown below:

Title page,
Item [75], Inventors, delete "Alelandro Wiechers" and insert
-- Alejandro Wiechers --.

Signed and Sealed this

Seventh Day of March, 2006

JON W. DUDAS
*Director of the United States Patent and Trademark Office*

UNITED STATES PATENT AND TRADEMARK OFFICE

CERTIFICATE OF CORRECTION

PATENT NO. : 6,854,903 B2 
DATED : February 15, 2005
INVENTOR(S) : Alejandro Wiechers et al.

It is certified that error appears in the above-identified patent and that said Letters Patent is hereby corrected as shown below:

Title page,
Item [75], Inventors, delete "Alelandro Wiechers" and insert -- Alejandro Wiechers --.

Signed and Sealed this

Eleventh Day of April, 2006

JON W. DUDAS
*Director of the United States Patent and Trademark Office*